United States Patent [19]

Hojnoski

[11] Patent Number: 4,889,251

[45] Date of Patent: Dec. 26, 1989

[54] CORK STOPPER FOR BOTTLES OF WINE

[76] Inventor: David E. Hojnoski, P.O. Box 412, Smithville Ontario, Canada

[21] Appl. No.: 225,723

[22] Filed: Jul. 28, 1988

[51] Int. Cl.[4] ..... B65D 39/16
[52] U.S. Cl. ..... 215/296; 53/489
[58] Field of Search ..... 215/296, 299, 300; 53/489

[56] References Cited

U.S. PATENT DOCUMENTS 1,204,712 11/1916 Spelling ..... 215/299
1,455,978 5/1923 Wentz ..... 215/296

*Primary Examiner*—Donald F. Norton

*Attorney, Agent, or Firm*—Watson, Cole, Grindle & Watson

[57] ABSTRACT

Disclosed is a stopper for wine bottles and the like which comprises an insert for a well in a wine cork and a puller device for operative association with the insert and cork when the stopper is in the neck of the bottle. The puller device as part of the stopper enables the cork to be pulled without auxilliary devices such as a corkscrew. The stopper insert is capable of being pre-assembled with the cork without any stress being imparted to the cork. This enables existing corking equipment to be used with the stopper. The puller device can be inserted after corking before lead foil is applied about the neck and cork stopper. With appropriate modification to corking equipment, the stopper of my invention could be totally preassembled before corking of the bottles.

10 Claims, 2 Drawing Sheets

CORK STOPPER FOR BOTTLES OF WINEFIELD OF THE INVENTION

The invention relates to a novel cork stopper and more particularly to a cork stopper having means associated therewith by which the stopper may be pulled or extracted from a bottle of wine and the like.

BACKGROUND OF THE INVENTION

The packaging of beverages is replete with novel approaches to providing simplified means for opening the packages, particularly in light of the demands of consumers as well as the demands of high speed production equipment.

Wine and related types of beverages are most often packaged in glass bottles and depending on the kind or quality of the wine, the bottles are sealed with a cork. Some wines are bottle packaged with "screw tops" and movement in this direction is obviously predicated to some extent on meeting consumer's demands for packaging which is easily opened without the necessity of additional equipment.

However, "corking" is still and will continue to play, a large part in wine packaging. Some wines, e.g. Champagnes, are corked with stoppers having enlarged heads and which can be grasped and twisted. However the majority of red, white and rose wines are "corked" with stoppers made out of cork which is recessed in the neck of the bottle requiring some implement such as a corkscrew to extract the cork.

There is a universal stigma related to the use of natural corks in table wine products predicated in large part on the need to use a corkscrew or other device for removal of the cork. Typically, women generally avoid the physical/mechanical requirement for removing corks from table wine products and have demonstrated a reluctance to purchase wine products due to the awkwardness of cork removal. Many consumers avoid purchasing "corked" bottles of wine due to the need to uncork the wine, there being some apprehension of breaking up the cork, failing to remove it properly and/or allowing cork particles to drop into the wine.

In "corking" wine, the cork is usually sized to a predetermined size for the particular bottle and after filling the bottle with wine, the cork is peripherally compressed and pushed into the neck of the bottle. Modern high speed bottling and corking equipment necessitates that the cork be presized and readily acceptable to established corking equipment.

Any modificiation to a cork stopper therefore must keep in mind the continued necessity of use of the same high speed corking equipment.

Applicant's invention is directed to providing a cork stopper having associated therewith a device for quick and easy removal of the cork without the necessity of a corkscrew or other like device and yet one that continues to meet the necessary type of established modern day "corking" equipment.

There have been attempts in the past to provide a cork stopper with a self-contained pulling device and the Spelling U.S. Pat. No. 1,204,712 is representative of such early prior art devices.

Spelling discloses a stopper made of cork or other yieldable substance having a well formed in the stopper into which well is forced two rounded members resembling a cone when placed together. The two half members have shoulders or shelves to indent the adjacent sides of the well upon the application of a spreading force between them. Pull means are provided for extracting the stopper. The well has a bottom and the two half members have rounded or tapered upper and lower peripheral edges to diminish strain at points where the cork would otherwise be liable to split and to intensify it at the points where pressure is needed. This arrangement leaves small irregularly bounded areas of the interior wall of the well "naked" after the rounded half members have been inserted. The stem of the puller is introduced through the restricted jaw opening causing the rounded half members to be temporarily spread apart. The "elasticity" of the substance of the stopper allows an adequate recession of the wall of the well "for this purpose". With the enlarged and wedge-shaped end of the stem having been pressed or forced into an interior space, the elastic exterior of the stopper rebounds and impacts on all parts of the stem and wedge but not so firmly as to prevent its movement up and down throughout the length of the interior space. However, the downward movement of the stem and its continuing pressure upon the other members causes the sharp edges of the shoulders to indent the substance of the stopper and all the interior members of the device to be firmly and tightly wedged. There are coacting means between the half members and in particular coacting parts which form a floor upon which the wedged-shaped end of the stem rests from the time of its insertion until the time when the stopper is to be extracted or removed.

The cap of the Spelling device comprises wings formed of yieldable metal or the like and is suitably secured to the top of the stem. The extremities of the wings will, upon contact with the uppermost rim of the container, spring outwardly upon the application of downward pressure and rebound to normal position when the extremities reach the under shelf of the rim. In extracting the stopper, the wings are doubled back upon each other and the fingers or a suitable tool inserted beneath them.

The Spelling device however is not designed for high speed bottling/corking equipment. In assembling the Spelling stopper, the rounded half members are co-engaged including the bottom floor means and the half members forced into the cork well, causing the walls of the cork to be put under outward stress and pressure. The stem and wedge shaped end are then forced through the jaw and trenches (restriction) thereby causing further expansion of the cork walls at least adjacent the top portion of the walls. The stress in the cork walls in assembling the stopper is significant, particularly when it is remembered that cork does not have the elasticity of rubber and will readily split when under tensile form of stress.

Further, there is no discussion in Spelling as to how the stopper is assembled with the bottle neck. The wings of the cap are of yieldable metal and pressure on the top of the stopper must be applied with care or else the stem will be pushed downwardly with the wedge shaped end forced against the co-engaging means forming the floor of the insert at the bottom of the well. Again, this type of tensile type force can stress the bottom of the cork well and cause a split in the cork material.

Even though the cork is under pressure within the neck of a bottle, wine bottles are usually stored on their sides or upside down. Wine penetrates a cork to some extent and a cork which has splits or weaknesses in it will allow the wine to leak further. In the case of Spelling, leakage of wine through the bottom of the cork and possibly through the floor of the insert would put the wine in contact with foreign material including perhaps metal which would be deleterious to the wine and prohibit the wine from being sold commercially and at retail.

Indeed although Spelling appears to refer to his stopper being of cork, the structure of his device and the manner of employment creates tensile stresses and requires elasticity of the material that is almost the antithesis of a cork stopper. The Spelling device is really only applicable in limited, carefully hand assembled cork stoppers or more tensile elastic type of stoppers of rubber-like material. Spelling even suggests that his invention is designed so the stopper is reusable, another aspect which anyone familiar with wine bottle cork stoppers will appreciate is not intended in the wine industry. The Spelling stopper device is not constructed for high compression and disposal, it is intrusion dependent and requires securement via stopper elasticity. If it is cork, this is extremely variable in the cork world.

Accordingly, notwithstanding the previous attempts to provide a stopper for bottles of wine and the like including means associated with the stopper for its removal, there is still a need for a wine cork stopper capable of preassembly with the cork without significant stress being imparted to the cork and which is acceptable to modern high speed production corking machines.

Further there is need for a cork stopper that may be removed with relative ease without the need of auxilliary equipment and one that does not or is likely not to cause discomfort or injury to the user.

SUMMARY OF THE INVENTION

The invention pertains to a stopper for wine bottles and the like which comprises an insert for a well in a wine cork and a puller device for operative association with the insert and cork when the stopper is in the neck of a bottle. The puller device as part of the stopper enables the cork to be pulled without auxilliary devices such as a corkscrew. The stopper insert is capable of being pre-assembled with the cork without any stress being imparted to the cork. This enables existing corking equipment to be used with my stopper. The puller device can be inserted after corking before lead foil is applied about the neck and cork stopper. With appropriate modification to corking equipment, the stopper of my invention could be totally preassembled before corking of the bottles.

More particularly the invention comprehends stopper apparatus for wine bottles and the like comprising: cylindrical cork means having a top surface, a closed bottom, and annular side wall with a cylindrical well in the cork means concentric with the annular side wall and having a bottom; a unitary plastic, generally cylindrical shaped, insert is within the well, the insert having an open top generally planar with the top surface of the cork and a closed bottom adjacent the bottom of the well, the cylindrical insert having a closed annular side wall with a plurality of interference means longitudinally spaced about the exterior thereof. The insert has a restriction therein associated with the inner wall of the insert which restriction is spaced a predetermined distance from the insert bottom. The restriction is of a predetermined diametric extent. The diametric extent of the insert including the interference means is substantially the same as the diameter of the well whereby the insert can be preassembled with the cork without inducing any substantial stress in the cork. There is puller means having a cap portion and integral shank portion, the free end of the shank portion having means for cooperation with the restriction means. The diametric extent of the shank portion and restriction means is such that the shank portion is moveable within the insert and relative to the restriction. Thus when the side wall of the cork is radially compressed, an interference fit is generated between the cork and the interference means of the insert such that the cork may be removed from a bottle when associated therewith by pulling on the cap of the puller means and the shank end is in cooperative engagement with the restriction means.

In one embodiment of the invention the insert restriction means comprises an annular restriction and the cooperating free end of the shank comprises a bifurcated end with outwardly directed shoulders for abutment with the annular restriction.

In another embodiment of the invention the insert restriction means comprises a threaded portion on the inner wall of the insert and the cooperating free end of the shank comprises a threaded portion for threaded engagement with the insert wall threaded portion. Preferably the longitudinal extent of the thread portions of the restriction means and the shank end is such that at least a portion of the threaded portions overlap and remain in engagement when the shank portion is fully within the insert.

The invention also comprehends the method of corking a bottle with a stopper comprising: providing a cork with a concentric well of predetermined size therein; providing an open topped but otherwise closed plastic insert having a plurality of interference means longitudinally spaced about an exterior surface thereof, the insert being of a predetermined longitudinal and diametric extent including the interference means relative to the well, and having internal restriction means; providing a puller means including a cap and integral shank, the shank including means associated with its free end for selective cooperation with the restriction means; inserting the insert fully into the cork well such that the cork is not substantially stressed; radially compressing the cork with the insert therein; inserting the compressed cork into the neck of a wine bottle; and inserting the shank of the puller means within the insert.

Another aspect of the invention comprehends the method of corking a bottle with a stopper comprising: providing a cork assembly with a concentric well of predetermined size therein and with an open topped but otherwise closed plastic insert in said well, the insert having a plurality of interference means longitudinally spaced about an exterior surface thereof, and being of a predetermined longitudinal and diametric extent including said interference means relative to said well, the insert also having internal restriction means; radially compressing said cork assembly and inserting said compressed cork assembly into the neck of a wine bottle; providing a plastic puller means including a circular cap and integral shank, said shank including means associated with its free end for selective cooperation with said restriction means; and inserting the shank of said puller within said insert.

DESCRIPTION OF THE PREFERRED EMBODIMENT

Figure 2:
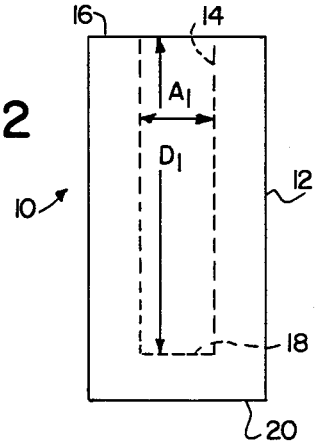
FIG. 2 is an elevational view of a cork showing in dotted lines a well therein.

Turning to FIG. 2, there is shown a cork 10 having outer peripheral surface 12 and a coaxial, right cylindrical shaped well 14 of a predetermined diameter which well may be drilled in cork 10 by known technology. Well 14 extends from top surface 16 to a bottom 18, short of the bottom surface 20 of the cork.

Figure 4:
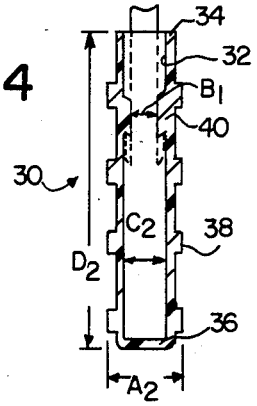
FIG. 4 is a longitudinal sectional view of the insert of FIG. 3.
Figure 3:
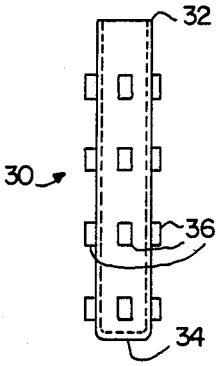
FIG. 3 is an elevational view of the exterior of the insert.

FIGS. 3 and 4 show insert 30 in a elevational view and elevational, sectional view respectively. Insert 30 is formed of a medium hard polyester resin such as polyethylene having a generally cylindrical configuration with cylindrical hole 32 extending from top 34 to closed bottom 36. Externally, insert 30 has a plurality of peripherally and longitudinally spaced generally rectangular shaped, lugs 38. Although interferrence means in the form of circumferentially extending ribs are, possible, lugs 38 are a preferred configuration since they provide enhanced interfering surfaces between insert 30 and cork well wall 14 without weakening the cork material as much as do circumferentially extending ribs. Internally insert 30 has a cylindrical collar or restriction 40 intermedite top 34 and closed bottom 36.

Insert 30 can be easily molded according to known technology.

Figure 5:
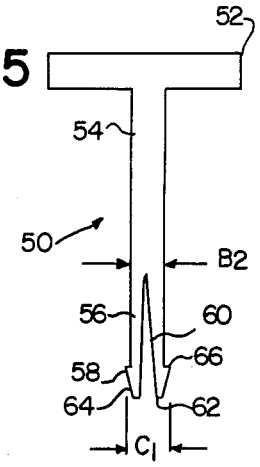
FIG. 5 is an elevational view of the puller element.
Figure 6:
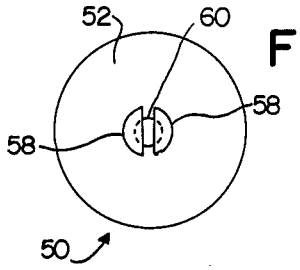
FIG. 6 is a bottom view of the puller shown in FIG. 5.

FIGS. 5 and 6 show a side elevational view and bottom view of puller 50 which comprises generally circular cap portion 52 and integral cylindrical shank portion 54, shank 54 having bifurcated end 56. End 56 has two generally mirror imaged prongs 58 formed by slot 60, each prong 58 having a generally flat lower end 62, outwardly, upwardly slanted or sloped outer face 64, and upper abutment or shoulder 66. The length of slot 60 is not critical but is sufficient to provide inward flexibility to prongs 58.

The diameter $A_1$ of well 14 (FIG. 2) is substantially the same as the diameter $A_2$ of insert 30 taken across diametrically opposed lugs 36 (FIG. 4).

The inner diameter $B_1$ of collar or restriction 40 (FIG. 4) is substantially the same as the diameter $B_2$ of shank portion 54. The diametric extent $C_1$ of end 56 across the most radially outwardly point of prongs 58 is similar to the diameter $C_2$ of cylindrical hole 52 both above and below collar or restriction 40.

Figure 1:
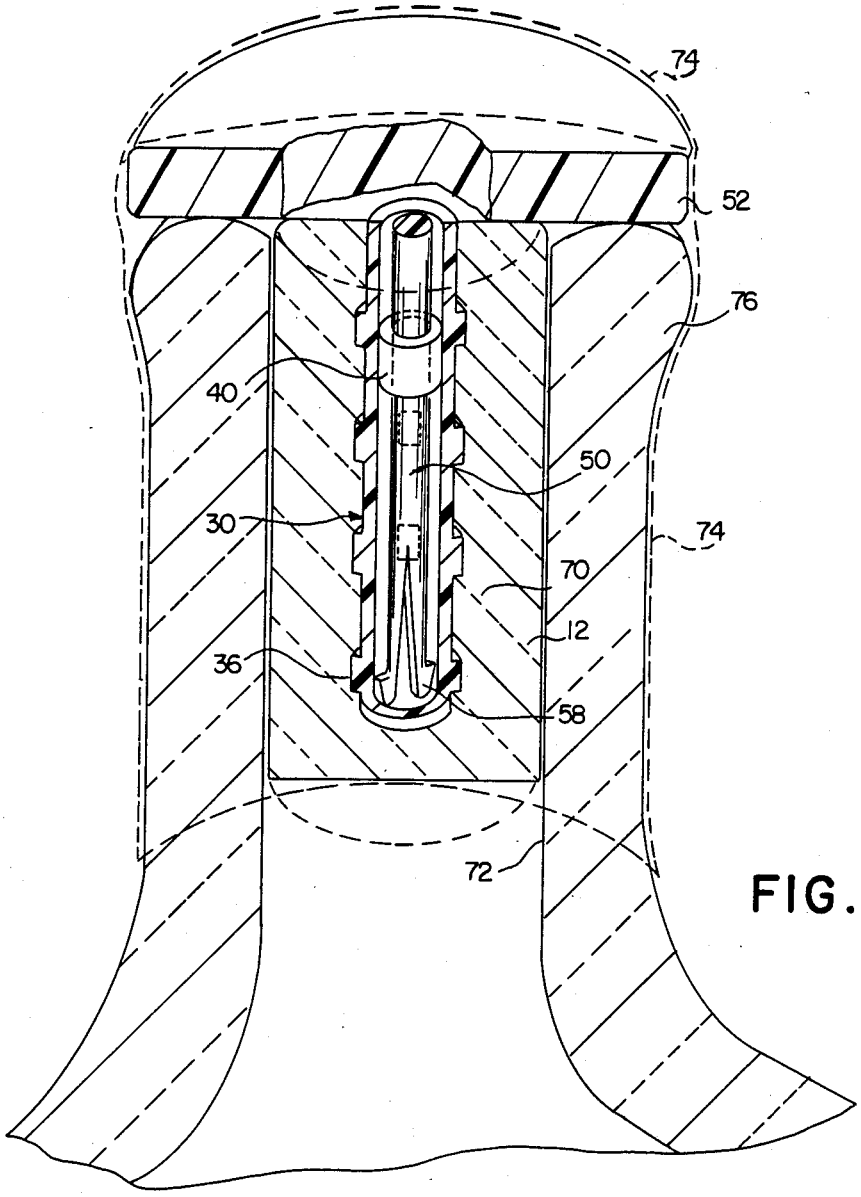
FIG. 1 is a front perspective view, partly in section, of my cork stopper in the neck of a wine bottle.

The length of shank portion 54 is substantially the length of well 14 and the diameter of cap 52 is substantially that of the outer diameter of the neck of a wine bottle. The length bottle $D_1$ of well 14 is substantially the length $D_2$ of insert 30. FIGS. 2, 4 and 5 in effect show an exploded view of the stopper parts and FIG. 1 shows them assembled in the neck of a wine bottle. With the above in mind and cork 10 in a natural or zero radial compression condition, i.e. one where it is not under any substantial stress, insert 30 is longitudinally inserted into well 14. The assembled cork 10 and insert 30 is ready for use in sealing a wine bottle or the like. During assembly of the stopper 70 with a wine bottle, the cork 10 is highly, radially compressed and inserted into the neck 72 of the wine bottle, the radial compression of the cork portion 10 causing a tight, longitudinally and radially uniform grip to be formed between the cork 10 and lugs 38 of insert 30. The assembled cork/insert can be used with known and existing corking machines and no modification of such machines is required.

The shaft portion 54 of puller 50 is then inserted within opening 32, the prongs 58 of bifurcated end 56 being momentarily flexed inwardly as they pass collar 40.

It will be appreciated that puller 50 could be assembled with insert 30 and cork 10 prior to the stopper being inserted in the neck of a bottle since the action of prongs 58 in assembly puller 50 with insert 30 does not stress cork 10. When cork 10, insert 30 and puller 50 are preassembled before corking a bottle, the width of cap 52 is substantially the width of the uncompressed cork 10 which is substantially the outside diameter of the neck of a bottle of wine. Cap 52 is also in contact with surface 16 of cork 10 so that any downward pressure on cap 52 is transferred to surface 16 and not transmitted through shank 54 to end 62 and bottom 18 of cork well 14. With this alternative, some modification to existing corking machine might have to be made whereby the radial compression means excludes radial contact with cap 52.

After the stopper is fully assembled with the bottle the usual lead foil covering, shown by dotted line 74 in FIG. 1 is applied over stopper 70 and bottle neck 76.

When wine is to be served, foil 74 is stripped off and cap portion 52 grasped such as between the first and second fingers and pulled upwardly whereupon shoulders or abutments 66 contact the bottom of collar 40 (see dotted line in FIG. 4). Further upward force then causes the insert and cork to be pulled out of the bottle neck 76 as a unit. It should be noted that even though the upper portion of a withdrawn cork may expand slightly, thereby causing the insert in that area to become looser in the cork well, the radial compression of the lower part of the cork about the lower group of lugs 38, particularly those adjacent bottom 36, still provides good interference between the cork and the insert in the area still within the neck of the bottle.

Figure 7:
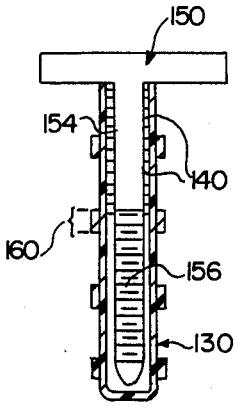
FIG. 7 is a side elevational view, partly in section, showing a modified form of the insert and puller means.

FIG. 7 illustrates a variation to the insert and puller device designated 130 and 150 respectively. The inner upper portion 140 of insert 130 is threaded and the end portion 156 of puller 150 is threaded. The longitudinal extent of the respective threads is such that there is a point or area 160 of overlap that is in continued threaded cooperation between puller 150 and insert 130 even when the puller 150 is fully within insert 130. This overlapping threaded engagement is such that when foil is removed from the neck of a bottle, puller 150 is rotated such that puller 150 is "unthreaded" until the threaded portion 156 of puller 150 and threaded portion 138 are in full longitudinal cooperation. The associated cork can then be pulled from the bottle neck in the same manner as cork 10.

By way of further illustration of the novel stopper, exemplary dimensions are noted herein. Cork 10 is about 49 mm long with an uncompressed diameter of about 24 mm, well 14 being about 10 mm in diameter by 43 mm long. Insert 30 is 43 mm long with the diameter of hole 32 about 6 mm and of restriction 40 about 4 mm. The outer diameter from lug to lug of insert 30 is 10 mm and the thickness of the walls are about 1 mm. Lugs 38 are about 3 mm (long) by 2 mm (wide) by 1 mm (thick) and are generally evenly spaced longitudinal and circumferentially with the first or lowest four lugs about 3 mm from the outer surface of bottom 38. Puller 50 has a cap 52 of about 26 mm diameter, 4 mm thick with shank 54 being about 4 mm diameter. Shank 54 is about 42 mm long and shoulders 36 have outer diameters of about 6 mm.

With respect to the variation shown in FIG. 7, the length of insert threaded portion 140 is about 19 mm with the length of the unthreaded portion of shank 154 being about 17 mm thereby providing a 2 mm overlap 160 for threaded engagement. The threaded portion 156 of shank 154 is about 22 mm long.

It will be apparent that various modifications and variations may be effected to my invention without departing from the spirit thereof and I claim all such modifications within the scope of the appended claims.

The embodiments of the invention in which an exclusive property or privilege is claimed are defined as follows:

1. Stopper apparatus for wine bottles and the like comprising:

cylindrical cork means having a top surface, a closed bottom, and annular side wall, a cylindrical well in said cork means concentric with the annular side wall and having a bottom;

a unitary plastic, generally cylindrical shaped, insert within said well, said insert having an open top generally planar with the top surface of said cork and a closed bottom adjacent the bottom of said well, said cylindrical insert having a closed annular side wall with a plurality of interference means longitudinally spaced about the exterior thereof, said insert having restriction means therein associated with an inner wall and spaced a predetermined distance from said insert bottom, said restriction means being of a predetermined diametric extent;

the diametric extent of said insert including said interference means being substantially the same as the diameter of said well whereby said insert can be presassembled with said cork means without inducing any substantial stress in said cork means;

puller means having a cap portion and integral shank portion, a free end of said shank portion having means for cooperation with said restriction means, the diametric extent of said shank portion and said restriction means such that said shank portion is moveable within said restriction means;

whereby, when said side wall of said cork is radially compressed, an interference fit is generated between the cork and said insert interference means such that the cork may be removed from a bottle when in operative association therewith by pulling on the puller cap means and the shank end is in cooperative engagement with said restriction means.

2. The stopper apparatus according to claim 1 wherein said restriction means comprises an annular restriction within said well and the cooperating free end of said shank comprises a bifurcated end with outwardly directed shoulder means for abutment with said annular restriction.

3. The stopper apparatus according to claim 1 wherein said restriction means comprises a threaded portion of the wall of said insert and the cooperating free end of said shank comprises a threaded portion for threaded engagement with the insert well threaded portion.

4. The stopper apparatus of claim 3 wherein the longitudinal extent of the threaded portions of said restriction means and said shank end are such that at least a portion of the threaded portions overlap and remain in engagement when the shank portion is fully within said insert.

5. The stopper apparatus of claims 2, 3 or 4 wherein said interference means comprise a plurality of lugs longitudinally and peripherally spaced about the insert.

6. The stopper apparatus of claims 2, 3 or 4 wherein the cap of said puller means is cylindrical and substantially the same diameter as the neck of a bottle with which the apparatus is to be used.

7. The method of corking a bottle with a stopper comprising:

providing a cork with a concentric well of predetermined size therein;

providing an open topped but otherwise closed plastic insert having a plurality of interference means longitudinally spaced about an exterior surface thereof, said insert being of a predetermined longitudinal and diametric extent including said interference means relative to said well, and having internal restriction means;

providing a plastic puller means including a circular cap and integral shank, said shank including means associated with its free end for selective cooperation with said restriction means;

assembling said insert with said cork well such that said cork is not substantially stressed;

radially compressing said cork with assembled insert and inserting said compressed cork into the neck of a wine bottle; and inserting the shank of said puller within said insert.

8. The method of claim 7 wherein said interference means comprise a plurality of lugs longitudinally and peripherally spaced about said inset external surface.

9. The method of claim 8 wherein said shank free end means comprise outwardly biased prongs for cooperative association with said restriction means.

10. The method of claim 8 wherein said shank free end means comprise threads and said restriction means comprise cooperative threads on the inside of said insert, and said inserting the shank of said puller within said insert comprises a treading action.

* * * * *